US006495268B1

(12) United States Patent
Harth, III

(10) Patent No.: US 6,495,268 B1
(45) Date of Patent: Dec. 17, 2002

(54) TAPERED CORROSION PROTECTION OF TUBES AT MUD DRUM LOCATION

(75) Inventor: George H. Harth, III, Wadsworth, OH (US)

(73) Assignee: The Babcock & Wilcox Company, New Orleans, LA (US)

( * ) Notice: Subject to any disclaimer, the term of this patent is extended or adjusted under 35 U.S.C. 154(b) by 0 days.

(21) Appl. No.: 09/670,897

(22) Filed: Sep. 28, 2000

(51) Int. Cl.[7] ..... F16L 9/14

(52) U.S. Cl. ..... 428/586; 428/585; 138/143; 285/332

(58) Field of Search ..... 428/583, 585, 428/586; 138/137, 143; 285/329, 332

(56) References Cited

U.S. PATENT DOCUMENTS 4,294,631 A 10/1981 Anthony et al.
4,887,847 A * 12/1989 Barnoach ..... 285/52
5,236,524 A 8/1993 Rawers et al.
5,447,179 A * 9/1995 Gibbs et al. ..... 138/143
5,569,396 A 10/1996 Topolski
6,044,805 A * 4/2000 Walker et al. ..... 122/512
6,046,426 A 4/2000 Jeantette et al.
6,060,686 A 5/2000 Jones

OTHER PUBLICATIONS

*Steam, Its Generation and Use*, 40$^{th}$ Edition, Stultz and Kitto, Eds, Copyright ©1992, The Babcock & Wilcox Company, pp. 7 and 8.

* cited by examiner

*Primary Examiner*—George Wyszomierski
(74) *Attorney, Agent, or Firm*—Eric Marich

(57) ABSTRACT

A method of corrosion protecting a tube having an end portion extending into a tube receiving hole of a mud drum of a boiler and the tube produced by that method. The end portion of the tube is provided with a corrosion resistant cladding layer which may contain chromium. Laser cladding is used to produce the corrosion resistant cladding layer, which advantageously tapers along a length of the end portion of the tube. The tube may be swaged before or after the cladding is applied and suitable heat treatments may be performed on the bare or clad tube to develop suitable properties in the tube, the cladding, or a tube-cladding interface.

23 Claims, 1 Drawing Sheet

FIGURE
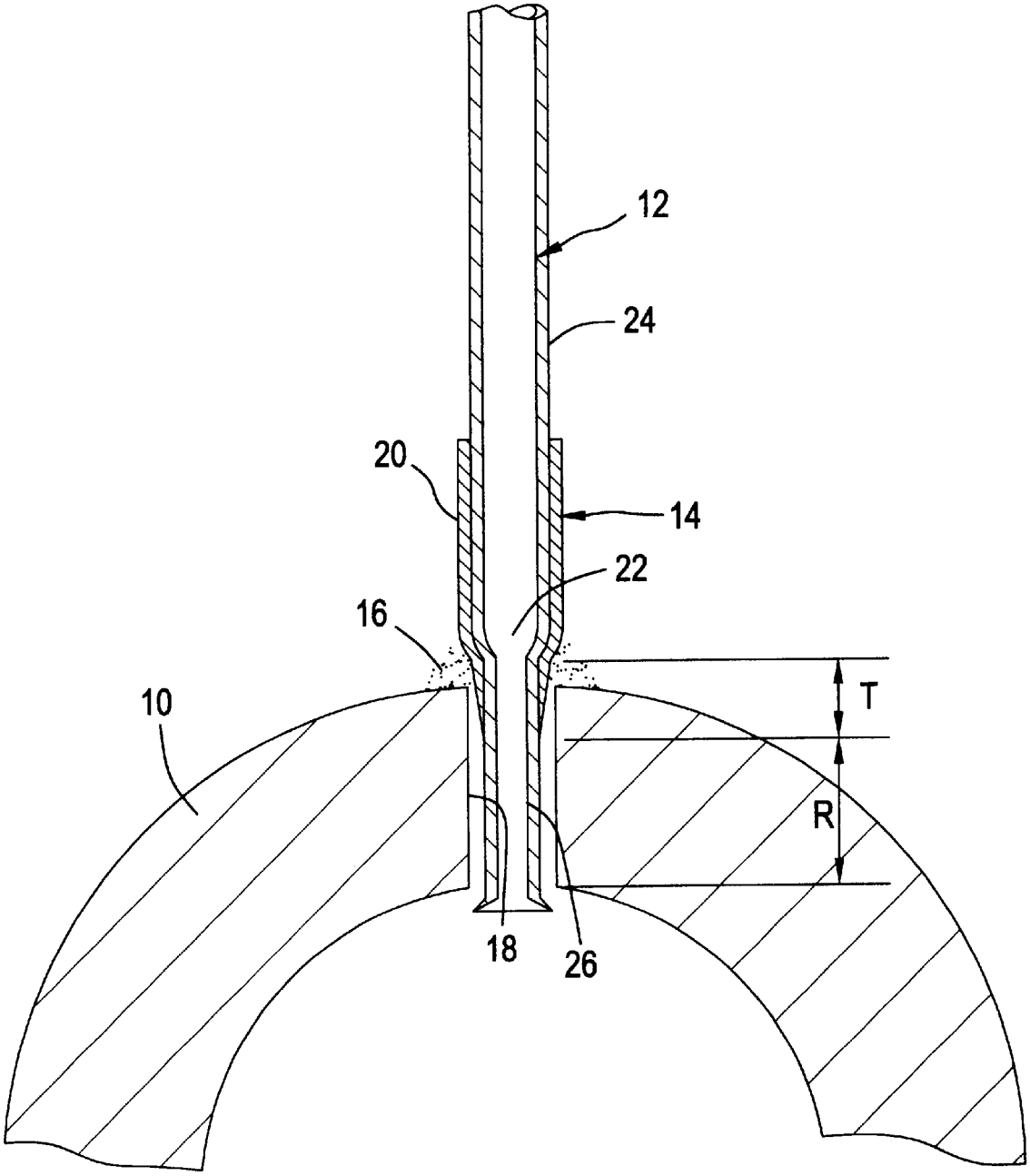

TAPERED CORROSION PROTECTION OF TUBES AT MUD DRUM LOCATION

FIELD AND BACKGROUND OF THE INVENTION

The present invention relates in general to boiler construction methods and arrangements and, in particular, to a new and useful method and apparatus for protecting tubes that are connected to a mud drum.

Industrial power boilers are commonly equipped with a boiler bank having an upper steam drum and a lower mud drum connected to the steam drum by a series of interconnecting steam generating tubes. For additional details of such boiler constructions, the reader is referred to Chapter 1, page 1–8 of *Steam/its generation and use,* $40^{th}$ edition, Stultz and Kitto, Eds, Copyright © 1992, The Babcock & Wilcox Company.

These boiler or steam generating banks (as the structures are also called) suffer from corrosion at the tube-mud drum interface due to OD deposits that occur in this location. There are no methods or arrangements known to the inventor for preventing this corrosion and the only remedy is to replace the corroded tubes.

U.S. Pat. No. 5,236,524 to Rawers et al. discloses a method for improving the corrosion resistance of a zirconium-based material by laser cladding. A laser beam is scanned across the entire surface of the material to cause surface melting of the material. A rapid selfquenching is provided by the underlying substrate. Homogeneous material formed during solidification of the molten pool improves the corrosion resistance of the material.

U.S. Pat. No. 4,294,631 to Anthony et al. discloses a method for improving the corrosion resistance of a body of zirconium alloy to high pressure and high temperature steam. A scanning laser beam heats a surface region substantially equally, without melting, to a temperature range sufficient to form a barrier layer of corrosion resistant beta-quenched zirconium alloy at the treated surface.

U.S. Pat. No. 6,060,686 to Jones discloses a laser welding or cladding method. The main purpose of the laser cladding process is to overlay the surface of a substrate with another material having a different chemistry by melting a thin or thick interfacial layer to produce a metallurgical bond with minimum dilution of the clad layer. Laser surface cladding is a process in which powder or wire of different compositions is delivered into the laser-generated melt pool. The powder or wire is also melted by the laser beam, thereby forming a layer of clad alloy having a desired thickness and a chemistry that is different from that of the substrate. Among the advantages of this technique are the ability to produce novel alloys, minimized clad dilution, reduced alloy material loss, reduced machining, and reduced distortion. Conventional laser welding occurs in the ambient atmosphere, typically using a suitable inert cover gas.

U.S. Pat. No. 6,046,426 to Jeantette et al. disclosed a method and system for producing complex-shape objects by laser cladding of materials.

U.S. Pat. No. 5,569,396 to Topolski discloses a method for making alloying additions to a weld overlay weld pool. The weld overlay process is well-established and has been in commercial use for many years. Several common welding processes used in weld overlaying include: submerged-arc, conventional or pulsed gas metal arc welding (GMAW), cold or hot wire gas tungsten arc welding (GTAW), shielded metal arc welding (SMAW), flux-core arc welding (FCAW), plasma transferred arc (PTA), laser welding, and electron beam welding. Typical applications include the cladding of tubes, pipes, flanges, and fittings with a corrosion-resistant layer. Additionally, the sealing and wear areas of valves and pumps may be clad for wear resistance. In addition to conventional arc welding processes, this reference teaches that laser or electron beam welding can be used to form a weld pool. The weld pool region is typically protected from oxidation by either using a gaseous shield or vacuum. In the process, the filler metal may also conduct the current to establish and maintain the welding arc (consumable electrode) or it may be separately fed (cold wire) into the arc or weld pool. The form of the filler metal can either be a wire, powder, or strip. The composition of the weld pool is a function of the composition of the filler metal and dilution by the metal component. The resultant corrosion or wear-resistant weld overlay clad layer is generally a function of the weld pool's composition.

SUMMARY OF THE INVENTION

One aspect of the present invention is drawn to a method for protecting the ends of steam generating tubes from corrosion at the tube-mud drum interface, a location that is particularly susceptible to corrosion, and the tubes produced by that method. Thus, one aspect of the present invention is drawn to a method of corrosion protecting a tube having an end portion extending into a tube receiving hole of a mud drum of a boiler, comprising: laser cladding a corrosion resistant cladding on an outside diameter of the tube along a length of the end portion of the tube.

Another aspect of the present invention is drawn to a tube having a corrosion resistant end portion for extending into a tube receiving hole of a mud drum of a boiler, comprising: a corrosion resistant laser cladding region on an outside diameter of the tube along a length of the end portion of the tube.

The tapered laser cladding region is provided on the outside diameter (OD) of the tube, prior to installation in the tube receiving hole in the mud drum, and in the area immediately above a hole in the mud drum which receives the tube. The tapered laser cladding region also extends partly into the hole, but does not extend into the rolled area of the tube.

According to the present invention, the alloy or alloy combination of either the tubes or the mud drum is not critical. The required thickness and composition of the cladding itself will depend on the corrosive environment to which the boiler mud drum and steam generating tubes are exposed and the degree to which such corrosion must be avoided. Examples of alloys for the tubes and boiler can be found in the above-identified publication *Steam/its generation and use.* Any corrosion resistant coating can be used for the tapered corrosion protection, but generally a high chromium content alloy which is either ferritic or nickel based is appropriate. The coating thickness may be on the order of 0.07 inches or less, tapering from a maximum thickness of about 0.10 inch to about 0.05 inch, gradually tapering to a thickness of 0.0 inch at the end of the tapered cladding portion which is within the tube receiving hole in the mud drum.

The thickness of the cladding must be controlled, however, to avoid interference between the clad tube and the drum hole for easy fabrication and attachment of the tubes to the drum. Thick coatings must not protrude into the mud drum, but must taper to allow the tube to be easily inserted into the hole to a depth sufficient for attaching the tube to the mud drum. As such, laser cladding is particularly useful for the present invention in that it is uniquely adapted to place the corrosion resistant cladding onto the tube in a tapered fashion.

The various features of novelty which characterize the invention are pointed out with particularity in the claims annexed to and forming a part of this disclosure. For a better understanding of the invention, its operating advantages and specific benefits attained by its uses, reference is made to the accompanying drawings and descriptive matter in which preferred embodiments of the invention are illustrated.

BRIEF DESCRIPTION OF THE DRAWINGS

The sole FIGURE is a schematic sectional view of the laser cladding of the present invention applied to an area of a mud drum tube which is particularly susceptible to corrosion.

DESCRIPTION OF THE PREFERRED EMBODIMENTS

Referring to the drawing, there is shown a schematic sectional view of a steam generating bank tube 12 inserted into an aperture or hole 18 of a mud drum 10. Persons skilled in the art of boiler design will appreciate the fact that the FIGURE is a simplified illustration of such a mud drum 10, since in practice several dozen or even hundreds of tubes 12 may be connected to the mud drum 10. The FIGURE illustrates the application of a cladding layer 14 which, according to the present invention is applied to an end portion of the tube 12 adjacent an area of the mud drum 10 which is particularly susceptible to corrosion.

At this area, corrosive deposits 16 tend to build up at the tube-mud drum interface. As the corrosion begins to extend into the tube hole 18, the likelihood for leaks and possible failure of the tubes at this location increases. By applying a layer of cladding 14 on an end portion of the tube 12 before installation of the tube 12 in the tube hole 18, the amount and degree of corrosion at this location will be greatly reduced. The present invention comprises not only a method for applying a corrosion protection to such tubes, but also the clad tubes 12 themselves.

The thickness of the laser cladding 14 provided on the ends of the tubes 12 can be adjusted such that the cladding 14 tapers in a region, generally designated T in the FIGURE, along a portion of the end of the tube 12. The particular extent of the tapered region T and the thickness of the cladding 14 in tapered region T can be varied as necessary to provide a thicker region of cladding 14 where required, typically in the area where corrosive deposits 16 occur. Conversely, the thickness of the cladding 14 can be reduced where the tube 12 penetrates into the tube holes 18 of the mud drum 10. No cladding 14 is provided on that portion of the tube 12, designated R in the FIGURE, which is to be expanded or "rolled-in" in the tube holes 18 to secure the tubes 12 to the mud drum 10. The technique of "rolling-in" tubes into tube holes 18 provided in such mud drums 10 is well known to those skilled in the art and will not be described in detail. The metallurgical composition of the cladding 14 is selected to be compatible with the tubes 12 while providing enhanced corrosion resistance from the OD deposits 16. The tapered laser cladding 14 may be applied either before or after the tube 12 is swaged to final dimensions. The bare or laser clad tube 12 may require heat treatment, such as annealing, to develop suitable properties in the cladding material 14, in the cladding-tube interface, and/or in the base tube 12. These heat treatments would be designed to restore or enhance the mechanical integrity of the clad tube 12 and to make the tubes 12 suitable for the subsequent tube rolling-in operation which attaches the tubes to the mud drum 10. These heat treatment operations might also be designed to develop suitable stable conditions to enhance the corrosion resistance of the tube 12. These heat treatment operations may be performed before or after any swaging operations have been performed on the tubes 12, and/or before or after the laser cladding layer 14 has been applied.

Preferably, the cladding layer 14 provided on the ends of the tubes 12 is applied using well-known laser cladding techniques, which are particularly suited to the task of providing a tapered cladding layer 14 on the tubes 12 prior to installation in the mud drum 10, according to the invention. Laser cladding methods permit closely controlled cladding 14 thicknesses to be applied to the ends of the tubes 12, thereby permitting the use of standard size tubes 12 and mud drum holes 18. It also permits expansion of the tubes 12 in the tube hole 18 along the rolled area R of each tube 12.

As illustrated, the FIGURE shows a method of corrosion protecting tube 12 extending into the tube receiving hole 18 of the mud drum 10 of a boiler (not shown) which comprises laser cladding an outside diameter of the tube 12 along the length T of the tube that extends into the hole 18, with a corrosion resistant cladding 14. The method includes using the laser cladding technique of know type for forming and tapering the cladding so that a thickness of the cladding decreases from a first thickness at a location on the end portion of the tube which is outside the hole (e.g. the top end of length T), to a second thickness at a location on the end portion of the tube which is inside the hole (e.g. the bottom of length T).

In the FIGURE tube 12 is shown to have an attachment portion, such as a rolled portion along length R in the hole 18 for attaching the tube to the mud drum 10. The cladding tapers to a second thickness of zero before the cladding reaches the attachment portion at the top of length R.

The tube 12 has a large diameter portion 24 outside the hole 18, a small diameter portion 26 inside the hole 18, and a transitional diameter portion 22 near the hole. The method includes applying the laser cladding 14 to have a substantially constant thickness 20 on the large diameter portion 24, and a tapering thickness on at least part of the small diameter 26 portion. The method also includes applying the laser cladding to have a substantially constant thickness on the transitional diameter portion 22 or applying the laser cladding to have a tapering thickness on the transitional diameter portion 22. The laser cladding 14 is applied to taper preferably from a maximum thickness of about 0.10 to about 0.05 inches at a location on the end portion of the tube outside the hole, to a minimum thickness of 0.0 inches at a location on the end portion of the tube inside the hole. A preferred maximum thickness is 0.07 inches. The laser cladding is also preferably a chromium alloy of ferritic or nickel based metal.

While a specific embodiment of the invention has been shown and described in detail to illustrate the application of the principles of the invention, it will be understood that the invention may be embodied otherwise without departing from such principles.

I claim:

1. A boiler tube having a corrosion resistant end portion for insertion into a tube receiving hole of a boiler mud drum, comprising a corrosion resistant, metallic, laser cladding region on an outside diameter of the tube along a length of the end portion of the tube, and an attachment portion which does not have any cladding, the attachment portion for extending into the tube receiving hole and attaching the tube to the mud drum when the attachment portion is expanded within the tube receiving hole.

2. The boiler tube according to claim 1, wherein the cladding region is tapered so that a thickness of the cladding decreases from a first thickness at a location on the end portion which is outside the receiving hole, to a second thickness at a location on the end portion which is inside the receiving hole when the tube is received in the hole in the mud drum.

3. The boiler tube according to claim 2, wherein the first thickness is about 0.10 to about 0.05 inches and second thickness is about 0.0 inches.

4. The boiler tube according to claim 2, wherein the cladding tapers to a second thickness of zero before the cladding reaches the attachment portion.

5. The boiler tube according to claim 1, wherein the end portion of the tube has a large diameter portion which is located outside the hole and a small diameter portion which is located inside the hole when the tube is attached to the mud drum, and a transitional diameter portion between the large and small diameter portions, the cladding having a substantially constant thickness on the large diameter portion, and a tapering thickness on at least a part of the small diameter portion.

6. The boiler tube according to claim 5, wherein the cladding has a substantially constant thickness on the transitional diameter portion.

7. The boiler tube according to claim 5, wherein the cladding has a tapering thickness on the transitional diameter portion.

8. The boiler tube according to claim 1, wherein the cladding is a chromium alloy.

9. The boiler tube according to claim 1, wherein the end portion of the tube was swaged before the cladding was applied to provide an outside diameter for inserting into the tube receiving hole of the mud drum.

10. The boiler tube according to claim 1, wherein the end portion of the tube was swaged after the cladding was applied to provide an outside diameter for inserting into the tube receiving hole of the mud drum.

11. The boiler tube according to any of claims 1–10, wherein the tube was heat treated prior to cladding to enhance the mechanical integrity of the tube for enduring rolling-in of the tube after the tube is inserted into the tube receiving hole of the mud drum.

12. The boiler tube according to any of claims 1–10, wherein the tube was heat treated after cladding to enhance the corrosion resistance of at least one of the tube, the cladding and a tube-cladding interface.

13. A boiler tube having a corrosion resistant end portion for insertion into a tube receiving hole of a boiler mud drum, comprising a corrosion resistant, metallic, laser cladding region on an outside diameter of the tube along a length of the end portion of the tube, wherein the cladding region is tapered so that a thickness of the cladding decreases from a first thickness at a location on the end portion which is outside the receiving hole, to a second thickness at a location on the end portion which is inside the receiving hole when the tube is received in the hole in the mud drum.

14. The boiler tube according to claim 13, wherein the first thickness is about 0.10 to about 0.05 inches and second thickness is about 0.0 inches.

15. The boiler tube according to claim 13, wherein the end portion of the tube has an attachment portion for extending into and attaching the tube to the mud drum, the cladding tapering to a second thickness of zero before the cladding reaches the attachment portion.

16. A boiler tube having a corrosion resistant end portion for insertion into a tube receiving hole of a boiler mud drum, comprising a corrosion resistant, metallic, laser cladding region on an outside diameter of the tube along a length of the end portion of the tube, wherein the end portion of the tube has a large diameter portion which is located outside the hole and a small diameter portion which is located inside the hole when the tube is attached to the mud drum, and a transitional diameter portion between the large and small diameter portions, the cladding having a substantially constant thickness on the large diameter portion, and a tapering thickness on at least a part of the small diameter portion.

17. The boiler tube according to claim 16, wherein the cladding has a substantially constant thickness on the transitional diameter portion.

18. The boiler tube according to claim 16, wherein the cladding has a tapering thickness on the transitional diameter portion.

19. The boiler tube according to any of claims 13–18, wherein the cladding is a chromium alloy.

20. The boiler tube according to any of claims 13–18, wherein the end portion of the tube was swaged before the cladding was applied to provide an outside diameter for inserting into the tube receiving hole of the mud drum.

21. The boiler tube according to any of claims 13–18, wherein the end portion of the tube was swaged after the cladding was applied to provide an outside diameter for inserting into the tube receiving hole of the mud drum.

22. The boiler tube according to any of claims 13–18, wherein the tube was heat treated prior to cladding to enhance the mechanical integrity of the tube for enduring rolling-in of the tube after the tube is inserted into the tube receiving hole of the mud drum.

23. The boiler tube according to any of claims 13–18, wherein the tube was heat treated after cladding to enhance the corrosion resistance of at least one of the tube, the cladding and a tube-cladding interface.

* * * * *